United States Patent [19]

Deutsch et al.

[11] Patent Number: 4,772,540

[45] Date of Patent: Sep. 20, 1988

[54] MANUFACTURE OF MICROSIEVES AND THE RESULTING MICROSIEVES

[75] Inventors: Mordechai Deutsch, Magdiel-Hod Hasharon; Tamar Landau, Rehovot, both of Israel; Richard E. Gordon, Westfield, N.J.

[73] Assignee: Bar Ilan University, Ramat Gan, Israel

[21] Appl. No.: 771,315

[22] Filed: Aug. 30, 1985

[51] Int. Cl.[4] ..... G03C 5/00

[52] U.S. Cl. ..... 430/320; 430/323; 430/324; 430/329; 430/394; 204/15

[58] Field of Search ..... 430/320, 324, 394, 323, 430/329; 204/15

[56] References Cited

U.S. PATENT DOCUMENTS

| | | | |
|---|---|---|---|
| 2,968,555 | 1/1961 | Bendler et al. | 430/323 |
| 3,139,392 | 6/1964 | Mears | 430/314 |
| 3,190,778 | 6/1965 | Dahlberg | 164/17 |
| 3,329,541 | 7/1967 | Mears | 156/644 |
| 3,403,024 | 9/1968 | Luce | 430/5 |
| 4,058,432 | 11/1977 | Schuster-Woldan et al. | 430/324 |
| 4,388,351 | 6/1983 | Sawyer | 427/304 |
| 4,415,405 | 11/1983 | Ruddle et al. | 156/645 |
| 4,497,884 | 2/1985 | Schmidt et al. | 430/5 |

FOREIGN PATENT DOCUMENTS 833141 1/1984 South Africa .

OTHER PUBLICATIONS

Du Pont's Brochure, Riston Image Transfer Systems, Du Pont Photoproducts Dept., Wilmington, Del., 11/1981.

*Primary Examiner*—John E. Kittle
*Assistant Examiner*—José G. Dees
*Attorney, Agent, or Firm*—Browdy & Neimark

[57] ABSTRACT

An ordinarily delicate microsieve is provided with greater resistance to mechanical distortion by being formed integrally with a rigid frame or by having its thickness built up to an extent where it is significantly more capable of withstanding flex.

18 Claims, 7 Drawing Sheets

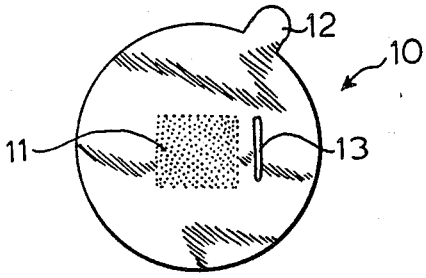
FIG. 3
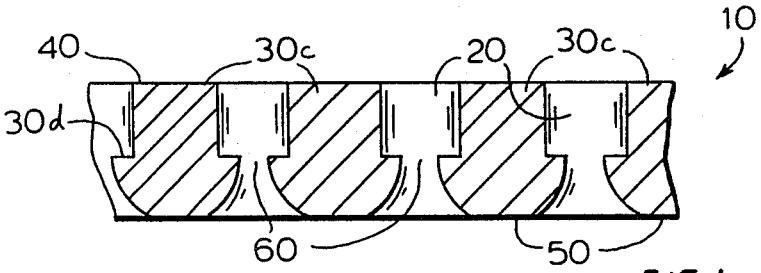
FIG. 4
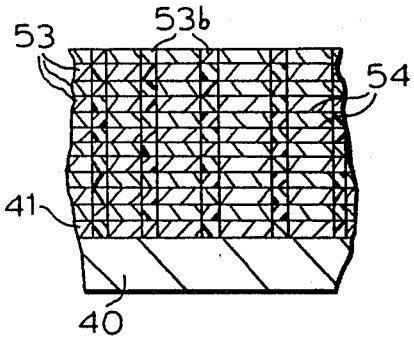
FIG. 8a
FIG. 8b
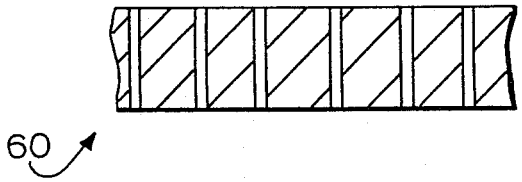

MANUFACTURE OF MICROSIEVES AND THE RESULTING MICROSIEVES

BACKGROUND OF THE INVENTION

This invention relates to improved methods for manufacturing extremely thin, very delicate metallic structures possessing grid-like patterns of minute, closely spaced, precisely dimensioned apertures. Such apertured metal structures, hereinafter referred to as "microsieves", are especially useful in sorting and sieving objects of only a few microns in size. One such microsieve, designated a "cell carrier", is described in Spanish patent No. 522,207, granted June 1, 1984, and in commonly assigned, copending U.S. patent application Ser. No. 550,233, filed Nov. 8, 1983, the disclosure of which is incorporated by reference herein, for classifying biological cells by size. The cell carrier is prepared employing a modified photo-fabrication technique of the type used in the manufacture of transmission electron microscope grids. The cell carrier is on the order of only a few microns in thickness and possesses a numerically dense pattern of minute apertures. Even with the exercise of great care, the very delicate nature of the cell carrier makes it difficult to manipulate, for example, to insert it in a holder of the type shown in aforesaid U.S. patent application Ser. No. 550,233, without causing it appreciable damage, frequently in the form of a structural deflection or deformation which renders it useless for its intended use.

In order to better understand and appreciate the improvements and advantages made possible by the present invention, the foregoing known type of microsieve, or cell carrier as it is called, and a method for its manufacture will be described in connection with the accompanying figures of drawing, all of which are greatly enlarged in size and with certain features exaggerated for the sake of clarity, in which FIG. 1(*a*) is a plan view of the cell carrier, FIGS. 1(*b*) and 1(*c*) are perspective and side elevational views, respectively, of a typical section of the cell carrier and FIGS. 2(*a*) through 2(*e*) are side elevational views of successive steps in the manufacture of a section of the cell carrier.

The cell carrier 10 shown in FIG. 1(*a*) is a very thin metallic disk, for example, about 8 to 10 microns in thickness, with a square-shaped, grid-like pattern of apertures 11 with centers about 15 microns apart defined within its geometric center. The cell carrier can be fabricated from a variety of metals including copper, nickel, silver, gold, etc., or a metal alloy. The apertures actually number 100 on a side for a total of 10,000 apertures and are thus able to receive, and retain, up to 10,000 cells of the desired size with each cell occupying a single aperture. Keyway 12 is provided to approximately orient the cell carrier within its holder.

As shown in FIGS. 1(*b*) and 1(*c*), a representative section of grid 11 of cell carrier 10 possesses numerous apertures or holes 20 arranged in a matrix-like pattern of rows and columns along axes X and Y respectively. This arrangement makes it possible to label and locate any one aperture in terms of its position along coordinates X and Y. The shape of apertures 20 enables biological cells 21 of preslected dimensions to be effectively held to the carrier by applying means, such as a pressure differential between the upper and the bottom side of the carrier, or electromagnetic forces. To first separate a particular group of cells from cells of other groups, carrier 10 is chosen to have apertures of sizes so that when the matter, for example, blood, containing the various cell groups is placed on carrier 10, most, if not all, of the apertures become occupied by cells of the group of interest with each aperture containing one such cell. Thus, the apertures can be sized to receive, say, lymphocytes of which there are two principal sizes, namely, those of 7 microns and those of 10–15 microns, with the former being the cells of most interest and the latter being washed away from the upper surface 10*t* of the grid under a continuous flow of fluid. To capture and retain the smalle size lymphocytes, apertures 20 will have an upper cross-sectional diameter of about 6 microns and a lower cross-sectional diameter of about 2 microns or so. In this way, a lymphocyte from the desired population of cells can easily enter an aperture but once it has occupied the aperture, it cannot pass out through the bottom side 10*b* of the carrier. The cut-out areas 30(*d*) about the bottom of each aperture have no functional significance and result from the procedures whereby the cell carrier is manufactured as discussed below in connection with FIGS. 2(*a*) through 2(*e*).

In the initial steps of the known method of manufacturing cell carrier 10 which are illustrated in FIGS. 2(*a*) through 2(*e*), a layer of photoresist 30, e.g., a photoemulsion, having a thickness, or height, generally on the order of about 1 micron or so, is applied to a metallic base plate, or mandrel, 31, e.g., of copper, upon which the carrier is to be formed. In FIG. 2(*b*), photoemulsion layer 30 has been selectively exposed to a source of actinic radiation employing a conventional mask procedure to produce a patterned surface of discrete areas of unexposed photoemulsion 30(*a*) surrounded by a continuous area 30(*b*) of exposed photoemulsion. Following conventional treatment of photoemulsion layer 30 with developer, fixer and finally, with clearing agent to wash away exposed area 30(*b*), there remains discrete areas of fixed photoemulsion 30(*a*) supported upon mandrel 31 as shown in FIG. 2(*c*). These fixed areas of photoemulsion correspond to the sites later defining the bottoms of apertures 20 in the finished carrier 10 and most frequently will be circular in cross-section. As shown in FIG. 2(*d*), a continuous layer of metal 30(*c*), e.g., copper, gold, nickel, silver, etc., or metal alloy, which is to provide the body of cell carrier 10, is electrodeposited upon mandrel 31. Since fixed areas 30(*a*) of the photoemulsion 10 are very thin, in order to build up the thickness of the carrier, or aperture height, some of metal 30(*c*) will inevitably overflow onto the peripheral edges of fixed areas 30(*a*) to form an aperture having a cone-shaped bore. Clearly, as one increases the thickness of the electrodeposited metal, the steeper will be the slope of the ultimate aperture bore. To prevent the aperture from becoming occluded by the overflow of electrodeposited metal, it is necessary to place the areas of fixed photoemulsion further apart as the thickness (i.e., the height) of electrodeposited metal layer 30(*c*) is increased. This has the necessary consequence of reducing the number of apertures which can be formed in the metal structure as its thickness is increased. In the final manufacturing steps shown in FIG. 2(*e*), mandrel 31 is removed and the fixed areas 30(*a*) of the photoemulsion are dissolved, or etched, away to provide carrier 10 containing the desired pattern, or grid, of apertures 20. A circumferential cut-away area 30(*d*) which possesses no role in the operation of the cell carrier is defined in the bottom of each aperture once fixed photoemulsion areas 30(*a*) are removed.

The aforedescribed method for making a microsieve is subject to a number of disadvantages, foremost among them being the practical difficulty of providing a sufficient thickness, or aperture height, without simultaneously unduly reducing the numerical density of the apertures. In addition, because of the thinness of the microsieve (typically weighing about 400 micrograms or so) which is obtainable by this manufacturing method, the structure is mechanically very fragile and as a result, is difficult to manipulate without causing it to be distorted or damaged. Still another disadvantage lies in the fact that the sloping sides of apertures 20 make it easy for them to be occupied by more than one cell. Ideally, an essentially vertical slope is desired to prevent or minimize this possibility; however, such a slope cannot be obtained with the foregoing method.

Other prior art which may relate to one or more features of the present invention can be found in U.S. Pat. Nos. 2,968,555; 3,139,392; 3,190,778; 3,329,541; 3,403,024; 4,058,432; 4,388,351; and 4,415,405.

SUMMARY OF THE INVENTION

By way of overcoming the foregoing drawbacks and deficiencies associated with the prior art method of manufacturing a microsieve, and the limitations inherent in the microsieve so manufactured, it is a principal object of the invention to provide a microsieve having a greater rigidity than heretofore practical or obtainable, and consequently, having a much greater resistance to mechanical distortion and other damage when manipulated as compared with the afore-described known type of microsieve.

It is another object of the invention to provide a microsieve in which the required rigidity is imparted thereto by the fact that it is integral with a rigid, self-supporting frame.

It is another object of the invention to provide a microsieve in which the required rigidity is imparted thereto by the fact that it has a greater thickness than has been dislosed in the prior art.

It is another object of the invention to provide a microsieve in which the required rigidity is imparted thereto by the fact that it is built up from successively laminated microlayers.

Yet a further object of the invention is to provide a microsieve in which a substantial proportion of the walls of the individual apertures are essentially perpendicular to the microsieve surface.

In keeping with the foregoing objects, an ordinarily delicate microsieve is provided with greater resistance to mechanical distortion by being integrally formed with a rigid frame or by having its thickness built up to an extent where it is significantly more capable of withstanding flex.

Since the microsieve is formed as an integral part of a larger, frame member, it can be readily handled without significant risk of damage.

The term "microsieve" as used herein shall be understood to include not only cell carriers and similar devices but other kinds of precision sieves, screens, grids, scales, reticules, and the like.

BRIEF DESCRIPTION OF THE DRAWINGS

FIG. 3 is a side elevational, greatly enlarged view of a portion of one embodiment of microsieve in accordance with this invention.

FIGS. 6, 7, 8(*a*) and 8(*b*) are side elevational views illustrative of still other embodiments of microsieves in accordance with this invention and the methods used in their manufacture.

DESCRIPTION OF THE PREFERRED EMBODIMENTS

Figure 1A:
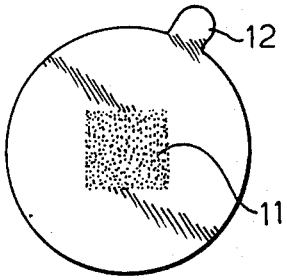
FIG.1a PRIOR ART
FIGS. 1(*a*) through 1(*c*) and 2(*a*) through 2(*e*) are illustrative of a known type of microsieve and its method of manufacture and are fully described above.
Figure 1B:
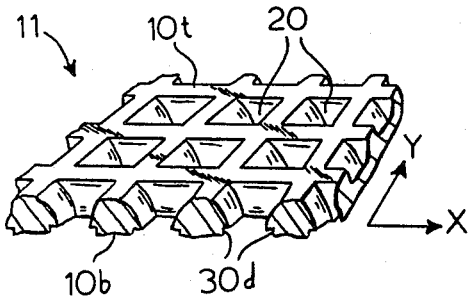
FIG.1b PRIOR ART
Figure 1C:
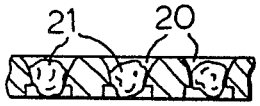
FIG.1c PRIOR ART
Figure 2A:
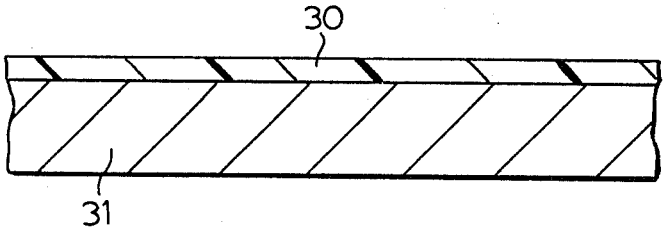
FIG. 2a PRIOR ART
Figure 2B:
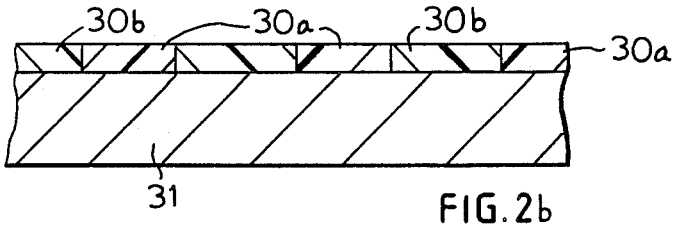
FIG. 2b PRIOR ART
Figure 2C:
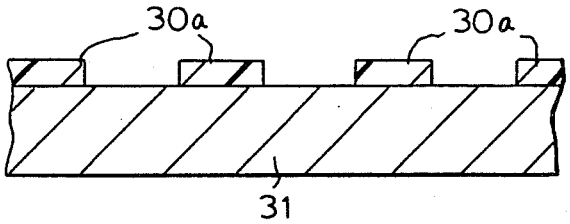
FIG. 2c PRIOR ART
Figure 2D:
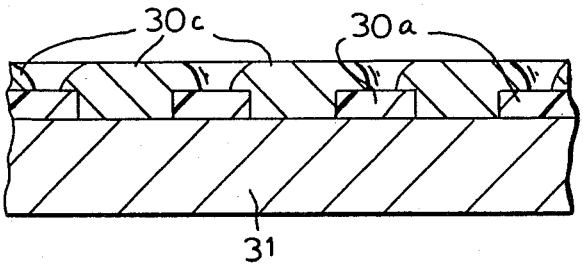
FIG. 2d PRIOR ART
Figure 2E:
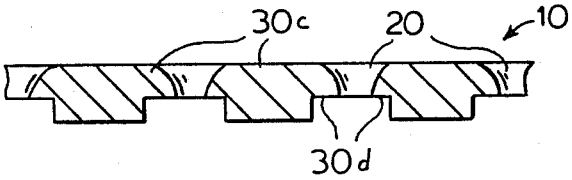
FIG. 2e PRIOR ART
Figure 5A:
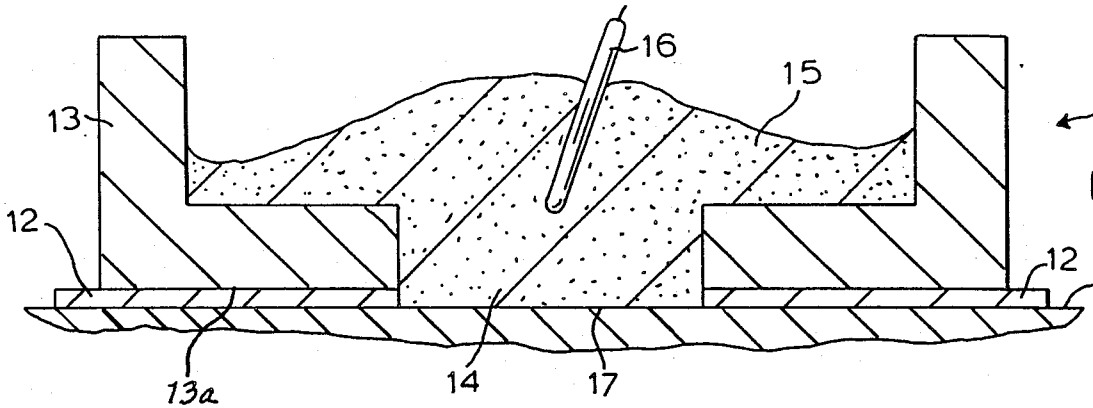
FIGS. 5(*a*) through 5(*f*) are side elevational views of successive steps in the manufacture of a frame-supported microsieve in accordance with the present invention.
Figure 5B:
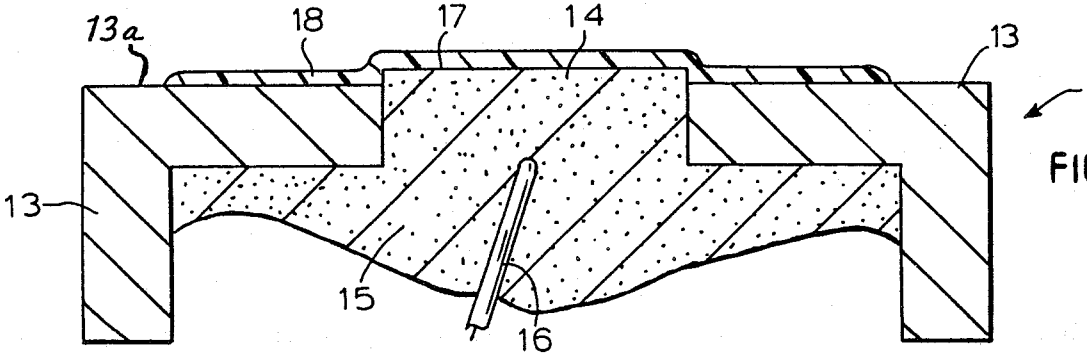
Figure 5C:
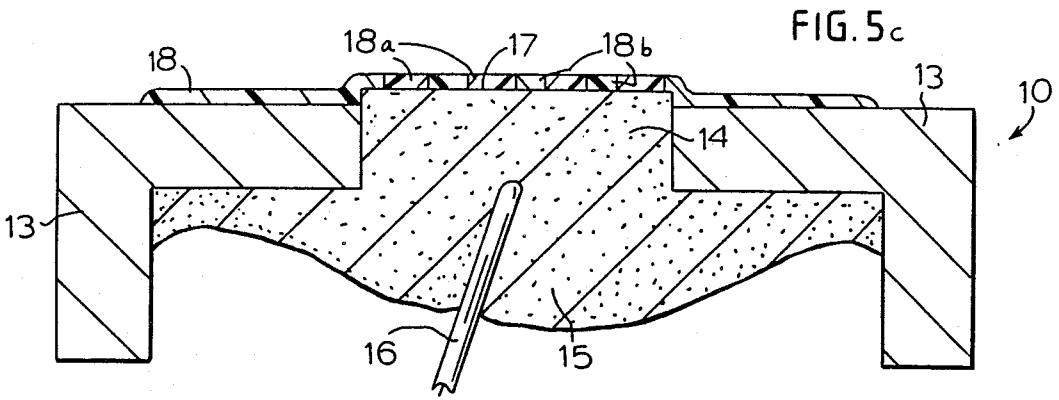
Figure 5D:
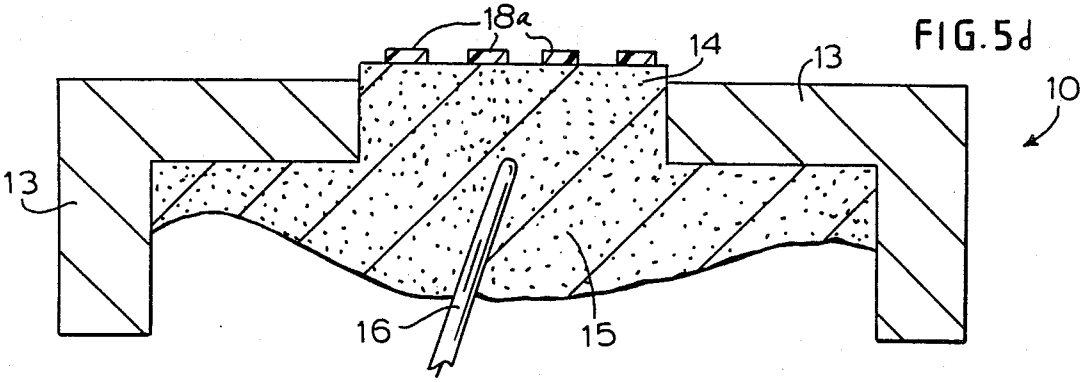
Figures 5E, 5F:
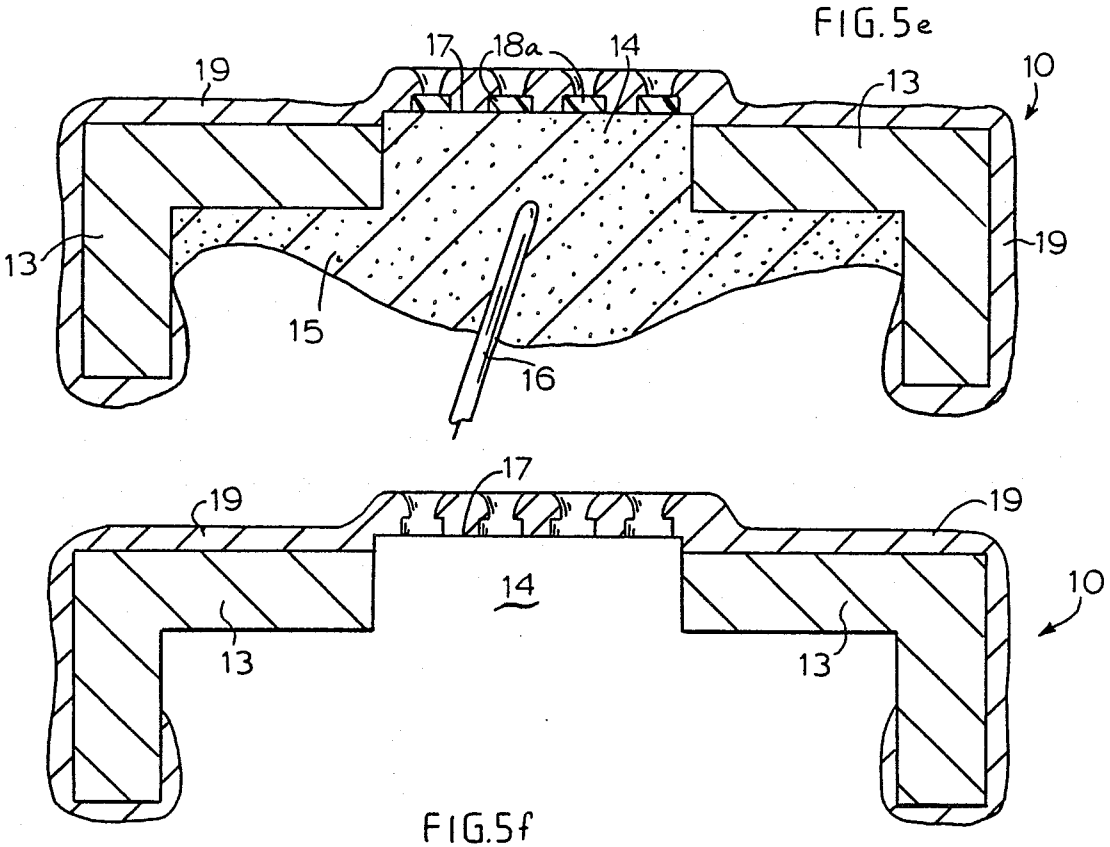

FIG. 3 is illustrative of a preferred microsieve in accordance with this invention shown generally at 10. As shown, the sides of apertures 20 are essentially vertical in contrast to the sloping sides of the apertures in the prior art microsieve of FIGS. 1(*a*)–(*c*). This arrangement helps to lessen the opportunity for more than one cell to occupy more than one aperture and also minimizes distortion of the light path which can result from apertures with comparatively gentle sloping walls.

Microsieve 10 of FIG. 3 is made by a modification of the known method illustrated in FIGS. 2(*a*)–(*e*). Specifically, instead of laying down a thickness of photoresist 30 of only about 1 micron as in FIG. 2(*a*), the thickness of the photoresist layer is made to be about 7 microns or so. Thus, when the fixed areas of photoresist are eventually removed to provide the sieve, undercut areas 30(*d*) will actually have the straight-bore configuration shown in FIG. 3. In use, the undercut areas 30(*d*) of microsieve 10 face upwardly, i.e., toward upper face 40. At upper face 40, the diameter of apertures 20 is about 6 microns and in the constricted area 60, the diameter is about 2 microns; the diameter of the opening at under surface 50 of microsieve 10 is of no significance to the functioning of the device.

Microsieve 10 of FIGS. 5(*a*)–(*f*) illustrates still another embodiment of the present invention. As shown in FIG. 5(*a*), surface 13*a* of rigid frame member 13 which is fabricated from an electrically conductive material such as copper, nickel, gold, silver, etc., is placed against a suitable nonadherent surface 11, e.g., one which is substantially optically flat, either directly thereon or indirectly upon a thin foil 12 which serves as a shim to separate surface 13*a* a short distance, e.g., 5 to 20 microns or so, from surface 11. Frame member 13 possesses a relatively large aperture 14, preferably circular in configuration and defined within the geometric center of surface 13*a* of the frame, filled with a hardenable electrically conductive material 15, e.g., Wood's alloy which solidifies below its melting point of about 65° C., to form a smooth surface 17. Electrical contact 16 is inserted before, during or after hardening of electrically conductive material 15. Once electrically conductive material 15 has become hardened, i.e., by being cooled to below its solidification point, it will possess a smooth surface 17 of electrically conductive material corresponding to the configuration of the large aperture 14 and surrounded by surface 13*a* of frame member 13. The sole function of surface 11 is to provide corresponding surface 17 of the electrically conductive material, when hardened, with a smooth, striation-free surface and that of optional foil 12 to extend surface 17 some short distance beyond surface 13*a* of frame 13. After electrically conductive material 15 has hardened, surface 13*a* of frame 13 is removed from contact with surface 11 and inverted to the face-up position as shown in FIG. 5(*b*). In the latter figure, a layer of photoresist 18, e.g., of a photoemulsion or photopolymerizable composition, is applied to surface 17 of electrically conductive material 15 and, for good measure, to at least a part of surface 13*a* of frame 13 to insure adequate and uniform coverage of the area which will eventually be occupied by the array of apertures constituting the microsieve. Typically, the height (or thickness) of photoresist 18 will be on the order of about 1 or 2 microns, the precise thickness being dependent in large measure upon the rheological properties of the particular photoresist selected.

In FIG. 5(*c*), conventional masking/exposure techniques (as described above in connection with FIGS. 2(*a*)–(*e*) which are illustrative of the prior art) provide a grid-like pattern of unexposed areas of photoresist 18(*a*) surrounded by a continuous area of exposed photoresist 18(*b*). Following conventional developing, fixing and clearing operations, there is provided the fixed areas of photoresist 18(*a*) supported on Wood's metal 15 as shown in FIG. 5*d*.

It will be understood that either positive or negative photoresists can be used in the practice of the invention in accordance with procedures which are well known to those skilled in the art.

In the following step shown in FIG. 5(*e*), a metal 19, e.g., copper, gold, silver, etc., is electrodeposited upon the exposed surfaces of frame member 13 as in the known method of manufacturing a microsieve described above. This electrodeposited metal 19 completely surrounds areas of fixed photoresist. As shown in FIG. 5(*f*), electrically conductive material 15 is removed from frame member 13, usually with only a simple breaking-away action, and the fixed areas of photoresist are removed by dissolution or etching with an appropriate solvent to provide the finished, completely self-supporting microsieve spanning what had originally been large aperture 14 of frame member 13.

Figure 6:
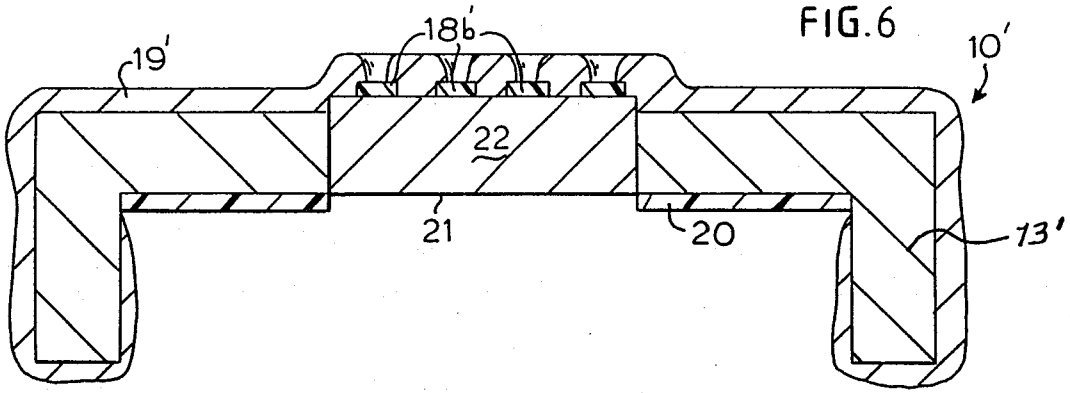

In the variation of the foregoing method illustrated in FIG. 6, copper frame member 13' of microsieve 10' initially does not possess an aperture. However, an etchant resistant, electrically non-conductive coating 20 is applied to the underside of frame member 13' except for an exposed, bare copper metal area 21 directly beneath the microsieve portion to be formed from electroplated nickel 19' layer. An etchant which selectively removes copper metal but which does not affect nickel is then used to remove central copper core 22 and fixed areas 18'*b* of photoresist are removed to provide a finished microsieve 10' similar to that shown in FIG. 5(*f*).

Figure 7:
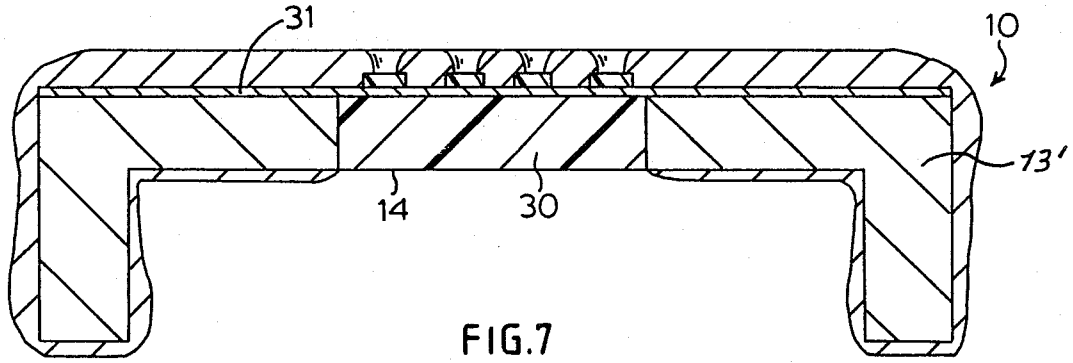

In yet another variation of the method described in FIGS. 5(*a*) through 5(*f*) which is shown in FIG. 7, central aperture 14 of frame member 13' is filled with a readily meltable or solvent-soluble electrically non-conductive material 30, e.g., a paraffin wax, in place of electrically conductive material 15 of FIG. 5(*a*). However, prior to applying photoresist as shown in FIG. 5(*b*), an electrically conductive metal 31, e.g., gold, silver, etc., is vapor deposited upon the complete upper face of frame member 10 to provide electroconductivity even in the area of the aperture occluded by material 30. Thereafter, the steps of applying photoresist, exposing, developing and fixing the photoresist, washing exposed photoresist away and electroplating metal are carried out as before. Finally, material 30 is removed, the exposed thin layer of vapor deposited metal 31 is selectively etched or otherwise removed and the fixed areas of photoresist are removed to provide the finished microsieve.

Another approach to imparting increased rigidity to a microsieve is illustrated in FIGS. 8(*a*) and (*b*). Here, the object is to build up the thickness of the microsieve body to the point where it becomes appreciably more resistant to flex, yet without sacrificing the numerical density of apertures.

As shown in FIG. 8(*a*), copper (or other electrically conductive metal) mandrel 40 possesses successive layers 41 to 53 of electroplated metal, e.g., nickel, surrounding fixed photoresist areas 53*b* which are in concentric alignment with the previously deposited areas of photoresist therebeneath. This method of manufacturing a microsieve requires that each layer of electroplated metal be no higher, or thicker, than the adjacent areas of fixed photoresist. Optionally, each of layers 41 to 53 can be separated by a layer 54 of vapor deposited metal of only a few angstroms thickness. With the removal of mandrel 40 and the fixed areas of photoresist 53*b*, there is obtained the finished microsieve 60 shown in FIG. 8(*b*).

The foregoing method makes it possible to vary the cross-sectional geometry of the aperture from one layer to the next and/or to stagger successive layers to obtain an aperture with a non-vertical bore.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in appended claims.

What is claimed is:

1. In the method of making a microsieve in which (a) a layer of photoresist is applied to an electrically conductive substrate, (b) preselected areas of the photoresist are fixed to provide a patterned surface in the form of a grid-like array of discrete areas of fixed photoresist, (c) the remaining photoresist is removed to expose a continuous area of the electrically conductive substrate, (d) the substrate is electroplated, and (e) the substrate and fixed photoresist are removed to provide a finished microsieve;

the improvement comprising imparting to the finished microsieve greater rigidity and resistance to mechanical distortion by:

preparing the electrically conductive substrate required for step (a) by the sub-steps of:

(i) providing a rigid, electrically conductive frame member having a relatively large aperture defined within a major surface thereof, the area constituting the large aperture being at least equal to the area of the grid-like array of micro-apertures possessed by the finished microsieve;

(ii) filling the large aperture with a hardenable electrically conductive material; and (iii) permitting the electrically conductive material to harden to provide a smooth-surfaced electrically conductive substrate corresponding to the configuration of the large aperture and surrounded by the electrically conductive frame member.

2. The method of claim 1 wherein the electrically conductive frame member is fabricated from copper or brass.

3. The method of claim 1 wherein the hardenable electrically conductive material is Wood's metal.

4. The method of claim 1 wherein the large aperture is defined by a circle of from about 1000 to about 3000 microns diameter, the center of the aperture being fixed at the geometric center of the major surface of the frame member.

5. The method of claim 1 wherein the photoresist is a photoemulsion.

6. The method of claim 1 wherein the discrete areas of fixed photoresist are about 1 to about 2 microns in height, from about 7 to about 11 microns across and separated from each other by a distance of from about 15 to about 25 microns, there being a total of from about 100 to about 10,000 of said discrete areas of fixed photoresist.

7. The method of claim 1 wherein the electroplated metal is nickel.

8. The method of claim 1 wherein the hardened, smooth surface electrically conductive material extends a short distance out from the plane of the surrounding surface of the frame member.

9. The method of claim 1 wherein the smooth surface of the hardened electrically conductive material is substantially optically flat.

10. In the method of making a microsieve in which
(a) a layer of photoresist is applied to an electrically conductive substrate,
(b) preselected areas of the photoresist are fixed to provide a patterned surface in the form of a grid-like array of discrete areas of fixed photoresist,
(c) the remaining photoresist is removed to expose a continuous area of the electrically conductive substrate,
(d) the substrate is electroplated, and
(e) the substrate and fixed photoresist are removed to provide the finished microsieve;
the improvement comprising imparting to the finished microsieve greater rigidity and resistance to mechanical distortion by:
preparing the electrically conductive substrate required for step (a) by the sub-steps of:
(i) providing a rigid frame member fabricated from an electrically conductive first metal and having a continuous upper and lower surface; and
(ii) applying to the lower surface an electrically non-conductive coating which is resistant to the action of an etchant for the metal of the frame member, said coating surrounding an exposed area of said lower surface which is directly below that portion of the upper surface to be provided with the microsieve, the uncoated upper surface providing the required substrate;
and thereafter in step (d) the electroplating is effected with a second metal which differs from the first metal; and
in step (e) the metal of the frame member directly beneath the electroplated metal which will constitute the microsieve is selectively etched, and finally the fixed photoresist is removed.

11. The method of claim 10 wherein the metal of the frame member is copper or brass and the electroplated metal is nickel.

12. The method of claim 10 wherein the photoresist is a photoemulsion.

13. In the method of making a microsieve in which
(a) a layer of photoresist is applied to an electrically conductive substrate,
(b) preselected areas of the photoresist are fixed to provide a patterned surface in the form of a grid-like array of discrete areas of fixed photoresist,
(c) the remaining photoresist is removed to expose a continuous area of the electrically conductive substrate,
(d) the substrate is electroplated, and
(e) the substrate and fixed photoresist are removed to provide a finished microsieve;
the improvement comprising imparting to the finished microsieve greater rigidity and resistance to mechanical distortion by:
preparing the electrically conductive substrate required for step (a) by the sub-steps of:
(i) providing a rigid, electrically conductive frame member having a relatively large aperture defined within a major surface thereof, the area constituting the large aperture being at least equal to the area of the grid-like array of microapertures possessed by the finished microsieve;
(ii) filling the large aperture with a hardenable electrically non-conductive material;
(iii) permitting the electrically nonconductive material to harden to provide a smoothsurfaced electrically non-conductive material corresponding to the configuration of the large aperture and surrounded by the electrically conductive frame member; and
(iv) vapor depositing an electrically conductive metal upon the entire combined surface of non-conductive material surrounded by electrically conductive material;
and thereafter step (e) is effected by removing the non-electrically conductive material from the large aperture to expose vapor deposited metal, and removing the fixed photoresist.

14. The method of claim 13 wherein the electrically non-conductive material is a paraffin wax.

15. The method of claim 13 wherein the photoresist is a photoemulsion.

16. In the method of making a microsieve in which
(a) a layer of photoresist is applied to a smooth-surfaced electrically conductive substrate,
(b) preselected areas of the photoresist are fixed to provide a patterned surface in the form of a grid-like array of discrete areas of fixed photoresist,
(c) the remaining photoresist is removed to expose a continuous area of the electrically conductive substrate,
(d) the substrate is electroplated, and
(e) the substrate and fixed photoresist are removed to provide a finished microsieve;
the improvement comprising imparting to the finished microsieve greater rigidity and resistance to mechanical distortion by:
effecting step (d) by electroplating metal upon the exposed substrate to substantially the same height, or thickness, of the areas of fixed photoresist to provide a patterned surface in the form of a grid-like array in minute, closely spaced, precisely dimensioned areas of fixed photoresist surrounded by a continuous area of electroplated metal; and
prior to step (e), applying another layer of photoresist upon the patterned surface, and repeating the sequence of steps taken so far, one or more times, provided that with each repetition of step (b), the areas of fixed photoresist are superimposed upon, and in predetermined alignment with, the previously obtained areas of fixed photoresist, provided also that in the last repetition of the sequence of steps, step (d) is omitted.

17. The method of claim 16 wherein the photoresist is a photoemulsion.

18. In the method of making a microsieve in which (a) a layer of photoresist is applied to a smooth-surfaced electrically conductive substrate, (b) preselected areas of the photoresist are fixed to provide a pattern surface in the form of a grid-like array of discrete areas of fixed photoresist, (c) the remaining photoresist is removed to expose a continuous area of the electrically conductive substrate, (d) the substrate is electroplated, and (e) the substrate and fixed photoresist are removed to provide a finished microsieve;

the improvement comprising imparting to the finished microsieve greater rigidity and resistant to mechanical distortion by:

effecting step (d) by electroplating metal upon the exposed substrate to substantially the same height, or thickness, of the areas of fixed photoresist to provide a patterned surface in the form of a grid-like array in minute, closely spaced, precisely dimensioned areas of fixed photoresist surrounded by a continuous area of electroplated metal;

prior to step (e), applying another layer of photoresist upon the patterned surface, and repeating the sequence of steps taken so far, one or more times, provided that with each repetition of step (b), the areas of fixed photoresist are superimposed upon, and in predetermined alignment with, the previously obtained areas of fixed photoresist, provided also that in the last repetition of the sequence of steps, step (d) is omitted and further, layers of vapor deposited metal are interposed between successive layers of electroplated metal.

* * * * *